US007618931B1

(12) United States Patent
Scheuing et al.

(10) Patent No.: US 7,618,931 B1
(45) Date of Patent: Nov. 17, 2009

(54) NATURAL HEAVY DUTY CLEANERS

(75) Inventors: David R. Scheuing, Danville, CA (US); Nancy Ann Falk, Livermore, CA (US); Sukhvinder Kaur, Dublin, CA (US); David Jackson Lestage, Livermore, CA (US); Erika Szekeres, San Ramon, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 12/343,202

(22) Filed: Dec. 23, 2008

Related U.S. Application Data

(63) Continuation-in-part of application No. 12/198,677, filed on Aug. 26, 2008, and a continuation-in-part of application No. 12/198,685, filed on Aug. 26, 2008.

(51) Int. Cl.

| | |
|---|---|
| ***C11D 1/12*** | (2006.01) |
| ***C11D 1/75*** | (2006.01) |
| ***C11D 3/22*** | (2006.01) |
| ***C11D 3/43*** | (2006.01) |

(52) U.S. Cl. ..... 510/340; 510/331; 510/342; 510/350; 510/351; 510/360; 510/426; 510/433; 510/437; 510/474; 510/481; 510/492; 510/499; 510/503

(58) Field of Classification Search ..... 510/331, 510/340, 342, 350, 351, 360, 426, 433, 437, 510/474, 481, 492, 499, 503
See application file for complete search history.

(56) References Cited

U.S. PATENT DOCUMENTS

| | | | | |
|---|---|---|---|---|
| 6,004,915 | A | 12/1999 | Elliot | |
| 6,060,440 | A | 5/2000 | Sackariasen | |
| 6,117,820 | A | 9/2000 | Cutler et al. | |
| 6,121,228 | A | 9/2000 | Drapier | |
| 6,537,960 | B1 | 3/2003 | Ruhr et al. | |
| 6,686,323 | B2 | 2/2004 | Nilsson et al. | |
| 6,759,382 | B2 * | 7/2004 | Ahmed | 510/424 |
| 2005/0233938 | A1 | 10/2005 | Delplancke | |
| 2006/0172889 | A1 | 8/2006 | Barnes et al. | |
| 2006/0258541 | A1 | 11/2006 | Crews | |

FOREIGN PATENT DOCUMENTS

| | | |
|---|---|---|
| WO | WO 00/49095 | 8/2000 |

* cited by examiner

*Primary Examiner*—Brian P Mruk
(74) *Attorney, Agent, or Firm*—Alok Goel

(57) ABSTRACT

A cleaning composition with a limited number of natural ingredients contains an anionic surfactant, a hydrophobic syndetic, a hydrophilic syndetic and a solvent. The cleaning composition can be used to clean laundry, soft surfaces, and hard surfaces and cleans as well or better than commercial compositions containing synthetically derived cleaning agents.

24 Claims, No Drawings

NATURAL HEAVY DUTY CLEANERS

CROSS-REFERENCES TO RELATED APPLICATION

This application is a continuation-in-part of both applications U.S. Ser. No. 12/198,677 and U.S. Ser. No. 12/198,685, both filed on Aug. 26, 2008, all of which are incorporated herein by reference.

BACKGROUND OF THE INVENTION

1. Field of the Invention

The present invention relates generally to naturally based cleaners, especially heavy duty cleaners, such as laundry detergents and soil and stain removers.

2. Description of the Related Art

Cleaning formulations have progressed and created a large chemical industry devoted to developing new synthetic surfactants and solvents to achieve ever improving cleaning compositions for the consumer. Recently, consumers have shown increasing interest in natural and sustainable products. Obstacles in selling such products include the expense to the consumer, since many conventional cleaners typically cost half as much as natural products or products based on sustainable materials. Another inconvenience to consumers of such products includes the limited distribution of natural products, which are often found only in speciality stores. Finally, there remains a significant gap in the performance of natural products, relative to that of highly developed formulations based on synthetic surfactants and solvents which are produced from petrochemical feedstocks. Companies marketing natural or sustainable consumer products have had difficulty in formulating cleaners that deliver acceptable consumer performance, while utilizing only a limited number of natural and/or sustainably produced components.

Typical cleaning formulations require multiple surfactants, solvents, and builder combinations to achieve adequate consumer performance. Because of the increased cost of synthetic sources for cleaning agents and a concern for the environment, there is a renewed focus on using materials that are naturally sourced.

For example, U.S. Pat. No. 6,759,382 to Ahmed discloses a concentrated liquid detergent composition containing a primary surfactant system alkylbenzene sulfonate and another sulfate or sulfonate and a secondary surfactant system containing an α-sulfomethyl ester or alkyl polyglucoside, where the alkyl polyglucoside is a $C_8$ to $C_{16}$ alkyl polyglucoside, a $C_8$ to $C_{10}$ alkyl polyglucoside, a $C_8$ to $C_{14}$ alkyl polyglucoside, a $C_{12}$ to $C_{14}$ alkyl polyglucoside, or a $C_{12}$ to $C_{16}$ alkyl polyglucoside. U.S. Pat. No. 6,686,323 to Nilsson et al. discloses $C_6$, $C_8$ and $C_{10}$ alkyl polyglucosides as surfactant for mud removal in oil drilling. U.S. Pat. No. 6,117,820 to Cutler et al. discloses agricultural formulations containing $C_8$ to $C_{10}$ alkyl polyglucosides, $C_9$ to $C_{11}$ alkyl polyglucosides, and 2-ethyl-1-hexylglucoside. U.S. Pat. App No. 20060172889 to Barnes et al. discloses agricultural formulations containing $C_7$ to $C_{18}$ alkyl polyglucosides. U.S. Pat. No. 6,537,960 to Ruhr et al. discloses $C_6$ and $C_8$ alkyl polyglucosides in highly alkaline formulations with amine oxides and alcohol alkoxylates. PCT App. No. WO 00/49095 to Landeweer et al. discloses $C_6$ to $C_{10}$ alkyl polyglucosides with glycol ethers such as butyl diglycol.

Prior art compositions do not combine effective cleaning with a minimum number of ingredients, especially with natural ingredients. It is therefore an object of the present invention to provide a cleaning composition that overcomes the disadvantages and obstacles associated with prior art cleaning compositions.

SUMMARY OF THE INVENTION

In accordance with the above objects and those that will be mentioned and will become apparent below, one aspect of the present invention comprises a natural heavy duty cleaning composition consisting essentially of a. an anionic surfactant selected from the group consisting of sodium lauryl sulfate, sodium alkyl α-sulfomethyl ester, and combinations thereof; b. a hydrophilic syndetic selected from the group consisting of $C_6$ alkyl polyglucoside, $C_6$ to $C_8$ alkyl polyglucoside, $C_8$ alkyl polyglucoside and combinations thereof; c. a hydrophobic syndetic selected from an amine oxide; d. a solvent selected from the group consisting of propylene glycol, 1,3-propanediol, ethanol, sorbitol, glycerol and combinations thereof; e. optionally a nonionic surfactant selected from the group consisting of alkyl polyglucosides having chain lengths greater than $C_8$, and combinations thereof; f. optionally an organic chelating agent from the group consisting of 2-hydroxyacids, 2-hydroxyacid derivatives, glutamic acid, glutamic acid derivatives, and mixtures thereof, and g. optional ingredients selected from pH adjusting agents, builders, calcium salts, boric acid or borate, enzymes, dyes, colorants, fragrances, preservatives, fluorescent whitening agents, bluing agents, defoamers, bleaches, thickeners, anti-redeposition polymers and combinations thereof, wherein the ratio of total syndetics:total base surfactant weight ratio is between 0.001 to 1.0.

In accordance with the above objects and those that will be mentioned and will become apparent below, another aspect of the present invention comprises a natural heavy duty cleaning composition consisting essentially of a. an anionic surfactant selected from the group consisting of a fatty alcohol sulfate, an alkyl α-sulfomethyl ester, and combinations thereof; b. a hydrophilic syndetic selected from the group consisting of $C_6$ alkyl polyglucoside, $C_6$ to $C_8$ alkyl polyglucoside, $C_8$ alkyl polyglucoside, $C_6$ alkyl sulfate, $C_6$ to $C_8$ alkyl sulfate, $C_8$ alkyl sulfate, and combinations thereof; c. a hydrophobic syndetic selected from the group consisting of an amine oxide, a fatty acid, a fatty alcohol, a sterol, a sorbitan fatty acid ester, a glycerol fatty acid ester, and combinations thereof; d. a solvent selected from the group consisting of propylene glycol, 1,3-propanediol, ethanol, sorbitol, glycerol and combinations thereof; e. pH 7-13; f. optionally a nonionic surfactant selected from the group consisting of an alkoxylated amine, alkyl polyglucoside having chain lengths from $C_8$ to $C_{20}$, alkyldiethanolamide, alkylethanolamide, and combinations thereof; g. optionally an amphoteric surfactant selected from the group consisting of sarcosinate, tauride, betaine, sulfobetaine and combinations thereof; h. optionally an organic chelating agent from the group consisting of 2-hydroxyacids, 2-hydroxyacid derivatives, glutamic acid, glutamic acid derivatives, and mixtures thereof; and i. optional ingredients selected from pH adjusting agents, alkanolamines, calcium salts, boric acid, enzymes, dyes, colorants, fragrances, preservatives, fluorescent whitening agents, blueing agents, defoamers, bleaches, thickeners, anti-redeposition polymers and combinations thereof, wherein the ratio of total syndetics: total base surfactant weight ratio is between 0.001 to 1.0.

Further features and advantages of the present invention will become apparent to those of ordinary skill in the art in view of the detailed description of preferred embodiments below, when considered together with the attached claims.

DETAILED DESCRIPTION OF THE INVENTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition alone, not accounting for the substrate weight. Each of the noted cleaner composition components is discussed in detail below.

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic, zwitterionic, amphoteric agents and/or combinations thereof.

The term "base surfactant", as used herein, refers to a surfactant or amphiphile that exhibits a strong tendency to adsorb at interfaces in a relatively ordered fashion, oriented perpendicular to the interface.

The term "syndetic" (meaning to join or link together, as in mixing water and oil), as used herein, refers to a relatively weak amphiphile which exhibits a significant ability to adsorb at an oil-water interface (from either the water phase, hence a "hydrophilic syndetic", or from the oil phase, hence a "hydrophobic syndetic") only when the interface already bears an adsorbed layer of a base surfactant or mixture of base surfactants. Adsorption of syndetics at oil-water interfaces is thought to affect the spacing and/or the order of the adsorbed ordinary surfactants in a manner that is highly beneficial to the production of very low oil-water interfacial tensions, which in turn increases the solubilization of oils and/or the removal of oils from solid surfaces.

The term "Interfacial Tension ("IFT")" refers to the excess surface free energy of the molecules residing at the interface of two immiscible phases, e.g., an aqueous phase and an oily phase, relative to that of the bulk phase(s). The concept of IFT is well known to those skilled in the art, and has been extensively discussed in references, such as C. A. Miller, P. Neogi: Interfacial Phenomena—Equilibrium and Dynamic Effects, 2nd. Ed., Surfactant Science Series, Vol. 139, 2007, CRC Press.

The term "Renewable Carbon Index ("RCI")" refers to the fraction (or percentage) of the carbon atoms in the average structure of, for example, an anionic surfactant, hydrophilic syndetic, hydrophobic syndetic or solvent which are derived from feedstocks other than petroleum or natural gas. Typically, and desirably, when such components of cleaners are produced from natural materials or in a sustainable manner, the RCI will be in excess 0.75 or "75%", due to the use of materials found in nature, or to the use of feedstocks derived from sustainable sources such as plants, fungi or algae, products of bacterial fermentation processes, or products of treatments of plant-, fungal- or algae-derived biomass. The major challenges in the formulation of cleaners with desirably high RCIs are the selection of a few suitable materials that are economically viable, while delivering performance that is as good as or better than the conventional products.

The term "total syndetics" refers to sum of the weight percentages of hydrophilic syndetics and hydrophobic syndetics in a composition.

The term "total base surfactant" refers to the sum of the weight percentages of anionic surfactant and any applicable nonionic and/or amphoteric surfactants in the composition.

The term "comprising", which is synonymous with "including," "containing," or "characterized by," is inclusive or open-ended and does not exclude additional, unrecited elements or method steps. See MPEP 2111.03. See, e.g., *Mars Inc. v. H.J. Heinz Co.,* 377 F.3d 1369, 1376, 71 USPQ2d 1837, 1843 (Fed. Cir. 2004) ("like the term 'comprising,' the terms 'containing' and 'mixture' are open-ended.") *Invitrogen Corp. v. Biocrest Mfg., L.P.,* 327 F.3d 1364, 1368, 66 USPQ2d 1631, 1634 (Fed. Cir. 2003) ("The transition 'comprising' in a method claim indicates that the claim is open-ended and allows for additional steps."); *Genentech, Inc. v. Chiron Corp.,* 112 F.3d 495, 501, 42 USPQ2d 1608, 1613 (Fed. Cir. 1997) See MPEP 2111.03. ("Comprising" is a term of art used in claim language which means that the named elements are essential, but other elements may be added and still form a construct within the scope of the claim.); *Moleculon Research Corp. v. CBS, Inc.,* 793 F.2d 1261, 229 USPQ 805 (Fed. Cir. 1986); *In re Baxter,* 656 F.2d 679, 686, 210 USPQ 795, 803 (CCPA 1981); *Ex parte Davis,* 80 USPQ 448, 450 (Bd. App. 1948). See MPEP 2111.03.

The term "consisting essentially of" as used herein, limits the scope of a claim to the specified materials or steps "and those that do not materially affect the basic and novel characteristic(s)" of the claimed invention. *In re Herz,* 537 F.2d 549, 551-52, 190 USPQ 461, 463 (CCPA 1976) (emphasis in original).

Syndetics Technology

The compositions can contain an anionic surfactant as a base surfactant, a hydrophilic syndetic, a hydrophobic syndetic and a solvent. Alternately, the compositions can contain an anionic surfactant and a nonionic surfactant as a total base surfactant mixture, a hydrophilic syndetic, a hydrophobic syndetic and a solvent. Alternately, the compositions can contain an anionic surfactant and an amphoteric surfactant as a total base surfactant mixture, a hydrophilic syndetic, a hydrophobic syndetic and a solvent. Alternately, the compositions can contain an anionic surfactant, a nonionic surfactant, and an amphoteric surfactant as a total base surfactant mixture, a hydrophilic syndetic, a hydrophobic syndetic and a solvent. One key component of the invention is the short-chain hydrophilic syndetic, which can rapidly adsorb at the interface between a water-immiscible oil and water, together with the base surfactant or surfactant mixture, resulting in very low IFT values, which are important for good detergency performance. The short-chain hydrophilic syndetic is preferably a $C_6$ alkyl polyglucoside, a $C_6$ to $C_8$ alkyl polyglucoside, or a $C_8$ alkyl polyglucoside. Alternative suitable hydrophilic syndetics are $C_6$ alkyl sulfate or $C_6$ to $C_8$ alkyl sulfate. A second key component is the hydrophobic syndetic, which can interact with the other components, including the oil and the total base surfactant or total base surfactant mixture. The incorporation of both hydrophilic and hydrophobic syndetics in formulations has been found to be highly beneficial in delivering formulations that can decrease the IFT between an aqueous solution and oily substances commonly encountered as "soils" by consumers. The incorporation of both hydrophilic and hydrophobic syndetics in formulations has also been found to be highly beneficial in delivering rapid reduction of the IFT, especially on the timescales relevant to consumer-perceived performance of the cleaner. For example, the incorporation of the syndetics has been found to enable reduction of the IFT values on timescales of 15 minutes or less, which is quite relevant to the laundering of garments via machines. As is well known in the art, the removal of oily substances from surfaces by cleaning formulations proceeds via either the so-called "roll-up" of oil, or "snap-off" of oil, or true "solubilization" of oil. The efficiency of all of these processes is improved by the reduction of IFT.

Anionic Surfactant

In one embodiment of the invention, the anionic surfactant is a fatty alcohol sulfate having a $C_{12}$ or longer chain, for example sodium lauryl sulfate. Typical alkyl sulfate surfactants are water soluble salts or acids of the formula $ROSO_3M$ wherein R preferably is a $C_{10}$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a cation, e.g., an alkali metal cation (e.g. sodium, potassium, lithium), or ammonium or substituted ammonium (e.g. methyl-, dimethyl-, and trimethyl ammonium cations and quaternary ammonium cations such as tetramethyl-ammonium and dimethyl piperidinium cations and quaternary ammonium cations derived from alkylamines such as ethylamine, diethylamine, triethylamine, and mixtures thereof, and the like). Typically, alkyl chains of include $C_{12}$-$C_{16}$ alkyl and $C_{16}$-$C_{18}$ alkyl chains.

In another embodiment of the present invention, the anionic surfactant is an α-sulfomethyl ester (MES). In a suitable embodiment, the α-sulfomethyl ester salt is an α-sulfomethyl ester of a fatty acid and can be chosen from a $C_{12}$-$C_{18}$ sodium methyl α-sulfomethyl ester and a $C_{12}$-$C_{18}$ disodium α-sulfo fatty acid salt. Because more than one α-sulfomethyl ester may be present, the present invention contemplates the use of both sodium methyl α-sulfomethyl ester and the disodium α-sulfo fatty acid salt in the secondary surfactant system. Commercially available sodium α-sulfomethyl esters that may be used in accordance with the present invention include ALPHA-STEP® ML-40 and ALPHA-STEP® MC-48, both sold by Stepan Company. A mixture of sodium methyl 2-sulfolaurate and disodium 2-sulfolaurate is preferred.

Other anionic materials include alkanoyl sarcosinates corresponding to the formula $R^1CON(CH_3)—CH_2CH_2—CO_2M$ wherein $R^1$ is a saturated or unsaturated, branched or unbranched alkyl or alkenyl group of about 10 to about 20 carbon atoms, and M is a water-soluble cation. Nonlimiting examples of which include sodium lauroyl sarcosinate, sodium cocoyl sarcosinate, and ammonium lauroyl sarcosinate. Other anionic materials include acyl lactylates corresponding to the formula $R^1CO—[O—CH(CH_3)—CO]_x—CO_2M$ wherein $R^1$ is a saturated or unsaturated, branched or unbranched alkyl or alkenyl group of about 8 to about 24 carbon atoms, x is 3, and M is a water-soluble cation. Nonlimiting, examples of which include sodium cocoyl lactylate. Other anionic materials include acyl lactylates corresponding to the formula $R^1CO—[O—CH(CH_3)—CO]_x—CO_2M$ wherein $R^1$ is a saturated or unsaturated, branched or unbranched alkyl or alkenyl group of about 8 to about 24 carbon atoms, x is 3, and M is a water-soluble cation. Nonlimiting examples of which include sodium cocoyl lactylate. Other anionic materials include acyl glutamates corresponding to the formula $R^1CO—N(COOH)—CH_2CH_2—CO_2M$ wherein $R^1$ is a saturated or unsaturated, branched or unbranched alkyl or alkenyl group of about 8 to about 24 carbon atoms, and M is a water-soluble cation. Nonlimiting examples include sodium lauroyl glutamate and sodium cocoyl glutamate. Also useful are taurates which are based on taurine, which is also known as 2-aminoethanesulfonic acid. Examples of taurates include N-alkyltaurines such as the one prepared by reacting dodecylamine with sodium isethionate according to the teaching of U.S. Pat. No. 2,658,072 which is incorporated herein by reference in its entirety. Other examples based of taurine include the acyl taurines formed by the reaction of n-methyl taurine with fatty acids (having from about 8 to about 24 carbon atoms). Other anionic surfactants include glutamates, such as sodium or triethylammonium cocoyl glutamate, and glycinates, such as potassium cocoyl glycinate.

Besides sodium other salts can include, for example, potassium, ammonium, and substituted ammonium salts such as mono-, di- and tri-ethanolamine salts of the anionic surfactant. The anionic surfactant is typically present in about 0.01 to about 50%, or about 0.01 to about 30%, or about 0.01 to about 20%, or about 0.01 to about 10.0%, or about 0.01 to about 5.0%, or about 0.01 to about 4.0%, or about 0.01 to about 3.0%, or about 0.01 to about 2.0% or about 0.01 to about 1.0%.

Nonionic Surfactant

In one embodiment of the invention, the cleaning compositions can optionally contain alkanol amides, and fatty acid amines surfactants. A suitable alkanolamide is a lower alkanolamide of a higher alkanoic acid, for example a monoalkanolamide chosen from lauryl/myristic monoethanolamide and coco monoethanolamide from Stepan Company®.

Other suitable surfactants include mono-alkoxylated amine surfactants preferably of the general formula: $R^1R^2R^3N^+ApR^4X^-$ wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8. Preferably the $ApR^4$ group in the formula has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are —CH2CH2—OH, —CH2CH2CH2—OH, —CH2CH(CH3)—OH and —CH(CH3)CH2—OH, with —CH2CH2—OH being particularly preferred. Preferred $R^1$ groups are linear alkyl groups. Linear $R^1$ groups having from 8 to 14 carbon atoms are preferred.

In one embodiment of the invention, the cleaning compositions contain one or more alkyl polyglucoside surfactants. The alkyl polyglucoside surfactant preferably has a naturally derived alkyl substituent, such as coconut fatty alcohol or a distilled cut of a natural fatty alcohol. Examples of alkyl polyglucoside that function as a nonionic surfactant, include but are not limited to, such as a $C_8$ to $C_{16}$ alkylpolyglucoside, a $C_8$ to $C_{10}$ alkylpolyglucoside, a $C_8$ to $C_{14}$ alkylpolyglucoside, a $C_{12}$ to $C_{14}$ alkylpolyglucoside, or a $C_{12}$ to $C_{16}$ alkylpolyglucoside.

Suitable alkyl polyglucoside surfactants are the alkyl polysaccharides that are disclosed in U.S. Pat. No. 5,776,872 to Giret et al.; U.S. Pat. No. 5,883,059 to Furman et al.; U.S. Pat. No. 5,883,062 to Addison et al.; and U.S. Pat. No. 5,906,973 to Ouzounis et al., which are all incorporated by reference. Suitable alkyl polyglucosides for use herein are also disclosed in U.S. Pat. No. 4,565,647 to Llenado describing alkylpolyglucosides having a hydrophobic group containing from about 6 to about 30 carbon atoms, or from about 10 to about 16 carbon atoms and polysaccharide, e.g., a polyglycoside (polyglucoside), hydrophilic group containing from about 1.3 to about 10, or from about 1.3 to about 3, or from about 1.3 to about 2.7 saccharide units. Typical hydrophobic groups include alkyl groups, either saturated or unsaturated, branched or unbranched containing from about 8 to about 18, or from about 10 to about 16, carbon atoms. Suitable alkyl polysaccharides are octyl, nonyl, decyl, undecyl, dodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The alkyl polyglucoside preferably has average chain lengths greater than $C_8$ alkyl polyglucoside. Suitable alkylglucoside surfactants include, for example, APG 425® (a coconut alkyl polyglucoside having naturally derived components available from Cognis Corporation), APG 325® (a $C_9$-$C_{11}$ alkyl polyglucoside available from Cognis Corporation), APG 625® (a $C_{10}$-$C_{16}$ alkyl polyglucoside available from Cognis Corporation), Dow Triton® CG110 (a $C_8$-$C_{10}$ alkyl polyglucoside available from Dow Chemical Company), and Alkadet 15® (a $C_8$-$C_{10}$ alkyl polyglucoside available from Huntsman Corporation). A $C_8$ to $C_{10}$ alkyl polyglucoside includes alkylpolyglucosides wherein the alkyl group is substantially $C_8$ alkyl, substantially $C_{10}$ alkyl, or a mixture of substantially $C_8$ and $C_{10}$ alkyl. Suitably, the alkyl polyglucoside is present in the cleaning composition in an amount ranging from about 0.01 to about 30 weight percent, or about 0.1 to about 30 weight percent, or about 10 to about 30 weight percent, or about 1 to about 5 weight percent, or about 2 to about 5 weight percent, or about 0.5 to about 5 weight percent, or about 0.5 to about 4 weight percent, or about 0.5 to about 3 weight percent, or about 0.5 to about 2.0 weight percent, or about 0.1 to about 0.5 weight percent, or about 0.1 to about 1.0 weight percent, or about 0.1 to about 2.0 weight percent, or about 0.1 to about 3.0 weight percent, or about 0.1 to about 4.0 weight percent, or greater than 2 weight percent, or greater than 3 weight percent.

The cleaning compositions preferably have an absence of other nonionic surfactants, especially petroleum derived nonionic surfactants, such as nonionic surfactants based on synthetic alcohols or ethoxylates. The present invention does not contain alkyl glycol ethers, alcohol alkoxylates, alkyl monoglycerolether sulfate, or alkyl ether sulfates.

Amphoteric Surfactants

The compositions can optionally contain amphoteric surfactants such as lecithin, alkyl betaines, alkyl sultaines, sulfobetaines, sarcosinates, taurides, alkyl amphoacetates, alkyl amphodiacetates, alkyl amphopropionates, and alkyl amphodipropionates. Suitable zwitterionic detergents for use herein comprise the betaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference.

Suitably, the amphoteric surfactant is present in the cleaning composition in an amount ranging from about 0.01 to about 30 weight percent, or about 0.1 to about 30 weight percent, or about 10 to about 30 weight percent, or about 1 to about 5 weight percent, or about 2 to about 5 weight percent, or about 0.5 to about 5 weight percent, or about 0.5 to about 4 weight percent, or about 0.5 to about 3 weight percent, or about 0.5 to about 2.0 weight percent, or about 0.1 to about 0.5 weight percent, or about 0.1 to about 1.0 weight percent, or about 0.1 to about 2.0 weight percent, or about 0.1 to about 3.0 weight percent, or about 0.1 to about 4.0 weight percent, or greater than 2 weight percent, or greater than 3 weight percent.

Hydrophilic Syndetic

In one embodiment of the invention the cleaning compositions contain one or more hydrophilic syndetics. Suitable short-chain hydrophilic syndetics include a $C_6$ alkyl polyglucoside, such as AG6206®, or a $C_6$ to $C_8$ alkyl polyglucoside, such as AG6202® from Akzo-Nobel® or $C_8$ alkyl polyglucoside. Other suitable short-chain hydrophilic syndetics include $C_6$ to $C_8$ alkyl sulfate, including hexyl sulfate, octyl sulfate, and 2-ethylhexyl sulfate. The alkyl chains are preferably straight chains and derived from natural oils, rather than branched chains, such as 2-ethylhexyl.

Suitably, hydrophilic syndetics are present in the cleaning composition in an amount ranging from about 0.01 to about 10 weight percent, or about 0.01 to about 5.0 weight percent, about 0.01 to about 4.0 weight percent, about 0.01 to about 3.0 weight percent, about 0.01 to about 2.0 weight percent, or about 0.01 to about 1.0 weight percent, or about 0.01 to about 0.5 weight percent, or about 0.01 to about 0.20 weight percent.

Hydrophobic Syndetic

In one embodiment of the invention the cleaning compositions contain one or more hydrophobic syndetics. Preferred hydrophobic syndetics are amine oxides. Suitable amine oxides include those compounds having the formula $R^3(OR^4)_xNO(R^5)_2$ wherein $R^3$ is selected from an alkyl, hydroxyalkyl, acylamidopropyl and alkylphenyl group, or mixtures thereof, containing from 8 to 26 carbon atoms; $R^4$ is an alkylene or hydroxyalkylene group containing from 2 to 3 carbon atoms, or mixtures thereof-, x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$-$C_{18}$ alkyl dimethylamine oxide, and $C_{10}$-$C_{18}$ acylamido alkyl dimethylamine oxide. Preferred amine oxides include but are not limited to, dimethyl alkyl amine oxide, amidoamine oxide, diethyl alkyl amine oxide and combinations thereof. In a more preferred embodiment, the amine oxide has $C_{12}$-$C_{18}$ alkyl chains.

Other preferred syndetics include fatty acids, such as oleic or palmitic acid. A fatty acid is a carboxylic acid that is often with a long unbranched aliphatic tail (chain), which is saturated or unsaturated. Fatty acids are aliphatic monocarboxylic acids, derived from, or contained in esterified form in an animal or vegetable fat, oil or wax. Natural fatty acids commonly have a chain of 4 to 28 carbons (usually unbranched and even numbered), which may be saturated or unsaturated. Saturated fatty acids do not contain any double bonds or other functional groups along the chain. The term "saturated" refers to hydrogen, in that all carbons (apart from the carboxylic acid [—COOH] group) contain as many hydrogens as possible. In contrast to saturated fatty acids, unsaturated fatty acids contain double bonds. Examples of fatty acids that can be used in the present invention, include but are not limited to, butyric acid, caproic acid, caprylic acid, capric acid, lauric acid, myristic acid, palmitic acid, stearic acid, arachdic acid, behenic acid, lignoceric acid, myristoleic acid, palmitoleic acid, oleic acid, linoleic acid, alpha-linoleic acid, linolenic, arachidonic acid, eicosapentaenoic acid, erucic acid, docosahexaenoic acid or mixtures thereof. The fatty acid suitably has a primary chain length (the predominant chain length) from $C_{12}$-$C_{20}$.

Other suitable hydrophobic syndetics are glycerol fatty acid esters and sorbitan fatty acid esters. The glyceryl alkyl or alkenyl ester is preferably a monoester of a $C_8$-$C_{22}$ carboxylic acid with glycerol. A suitable example is CITHROL GML® which is glyceryl monolaurate. The sorbitan alkyl or alkenyl ester preferably contains from 8 to 22 carbon atoms in the ester group. An especially suitable sorbitan ester is a sorbitan monolaurate such as that available under the trade name SPAN 20®. Another suitable sorbitan ester is SPAN 80®. Other suitable hydrophobic syndetics are fatty alcohols, which are the reduction product of fatty acids. Other suitable hydrophobic syndetics are sterols, especially plant sterols such as campesterol, sitosterol, stigmasterol, lanosterol, avenasterol, and cycloartenol.

Suitably, hydrophobic syndetics are present in the cleaning composition in an amount ranging from about 0.01 to about 10 weight percent, or about 0.01 to about 5.0 weight percent, about 0.01 to about 4.0 weight percent, about 0.01 to about 3.0 weight percent, about 0.01 to about 2.0 weight percent, or about 0.01 to about 1.0 weight percent, or about 0.01 to about 0.5 weight percent, or about 0.01 to about 0.20 weight percent.

Base Surfactant

The term "base surfactant", as used herein, refers to a surfactant or amphiphile that exhibits a strong tendency to adsorb at interfaces in a relatively ordered fashion, oriented perpendicular to the interface. Anionic surfactants with hydrophobic tails longer than 10 carbon atoms and a charged ionic head group tend to act as base surfactants. A base surfactant is able to facilitate the expansion of the interface between an aqueous solution and an oily substance due to its strong tendency to adsorb at the interface, which eliminates the direct contact (on the molecular size scale) between the aqueous solution and the oily substance or oily phase, which in turn is necessary for the removal of oily soils from, for example, fabrics in laundry applications. A well-known shortcoming of surfactants (amphiphiles) that exhibit a very strong ability to adsorb at interfaces (sometimes referred to as exhibiting "strong" amphiphilicity) is the tendency to interact with themselves, as well, thereby reducing the interaction between the aqueous solution and the surfactant. When the interaction between the aqueous phase and the "self-interacting" or "self-aggregated" surfactant is inadequate the surfactant forms a separate, sometimes ill-defined coacervate-like phase, a liquid crystal phase, a vesicle phase, or a mixture of these phases, and is hence no longer available for adsorption at the interface between the aqueous phase and the oily substance or oily soil phase, and hence the detergency performance is poor. In such cases, it is then important to adjust the "strength" of the amphiphilicity of the surfactant to bring it into a preferred range, thereby achieving improved cleaning performance. It was surprisingly found that combinations of hydrophilic and hydrophobic syndetics are able to provide the necessary adjustment, and that incorporation of syndetics provides a significant improvement in the overall detergency performance of formulations that are significantly more natural and/or sustainable than those used in products currently available.

Interfacial Tension ("IFT")

One aspect of the invention involves tuning the IFT between the aqueous cleaning composition at use dilution and a suitable oil, representing the oily soil of interest. The tuning of the IFT can be achieved by selecting the appropriate ratio between the base surfactant(s) and the hydrophilic and hydrophobic syndetics. Canola oil has been found useful in representing the oily soils of significant concern to consumers in a variety of cleaning tasks, including laundering of garments and cleaning of dishes, tableware and the like. However, it is also contemplated that formulation of some natural cleaners in which the oily soil of interest could be significantly chemically different from canola oil could also specifically benefit from a tuning of the IFT via the use of hydrophilic and hydrophobic syndetics. In such cases, substitution of canola oil with a different model oil, for example, common motor oil, a mineral oil, etc. in the IFT experiments could readily be achieved by one skilled in the art. The formulations described herein below were diluted 1:1150 with water containing 100 ppm hardness for use as the aqueous phase in contact with the canola oil. Such a dilution rate corresponds to the usage rates of liquid laundry detergents with which consumers are familiar. The interfacial tensions were measured with a spinning drop tensiometer. Experimental aspects of spinning drop tensiometry have been described in A. W. Adamson and A. P. Gast: Physical Chemistry of Surfaces, $6^{th}$ ed. Wiley & Sons, Inc., New York, 1997. IFT values between the diluted formulations in hard water and the canola oil below 0.3 mN/m were found to be necessary in order for the formulations to exhibit good to excellent overall detergency performance on a wide variety of common stains a consumer might encounter on garments.

Those skilled in the art realize that the overall average surfactant mixture hydrophilicity has a direct influence on the IFT. In conventional compositions, if the surfactant mixture selected is too hydrophilic for a given oil of interest, the IFT increases, resulting in a decline in the detergency performance. Thus, a reduction in the hydrophilicity of the formulation is typically sought and an improvement in the detergency performance achieved. One of the novel features of the instant invention is that a new and surprising way becomes available to further reduce the IFT via the adjustment of the ratio between the base surfactant(s) and the total syndetic amphiphile(s). As a consequence, it is possible to decrease IFT of a formulation by increasing the concentration of the most hydrophilic component, the hydrophilic syndetic, which is in direct contrast to results obtained when the formulations contain ordinary surfactants and no syndetics. Applicants have also observed an additional benefit which, without being bound by theory, is believed to be due to the small molecular size of the hydrophilic syndetic amphiphiles used in the invention. The small hydrophilic syndetic molecules have high mobility in the aqueous environment, and consequently reach interfaces quickly and therefore achieve a rapid IFT reduction. It is believed that for improved detergency performance it is important to achieve not only a low equilibrium IFT below 0.3 mN/m, but also to achieve it quickly relative to the time scale of the particular cleaning application. Therefore, two key benefits provided by the invention are the low equilibrium IFT and the rapid IFT reduction, both of which help improve cleaning performance. These benefits can be realized by appropriately selecting the ratio of the syndetics and the base surfactant(s).

In one embodiment, the base surfactant, the hydrophilic syndetic and the hydrophobic syndetic reduce the interfacial tension between water and a canola oil below about 0.35 mN/m, as measured via spinning drop tensiometry at 25° C., in less than 15 minutes after contacting said composition with said canola oil. In another embodiment, the base surfactant, the hydrophilic syndetic and the hydrophobic syndetic reduce the interfacial tension between water and a canola oil below about 0.3 mN/m, as measured via spinning drop tensiometry at 25° C., in less than 15 minutes after contacting said composition with said canola oil. In another embodiment, the base surfactant, the hydrophilic syndetic and the hydrophobic syndetic reduce the interfacial tension between water and a canola oil below about 0.25 mN/m, as measured via spinning drop tensiometry at 25° C., in less than 15 minutes after contacting said composition with said canola oil. In another embodiment, the base surfactant, the hydrophilic syndetic and the hydrophobic syndetic reduce the interfacial tension between water and a canola oil below about 0.20 mN/m, as measured via spinning drop tensiometry at 25° C., in less than 15 minutes after contacting said composition with said canola oil.

Ratios

Certain ratios of components can further define the present invention. One measurement is to evaluate and analyze the ratio of the total syndetics:total base surfactant weight ratios. The term "total syndetics" refers to sum of the weight percentages of hydrophilic syndetics and hydrophobic syndetics in a composition. The term "total base surfactant" refers to the sum of the weight percentages of anionic surfactant and any applicable nonionic and/or amphoteric surfactants in the composition. In one aspect of the invention, the total syndetics:total base surfactant weight ratio is between about 0.001 to about 1.0, or about 0.001 to about 0.9, or about 0.001 to about 0.8, or about 0.001 to about 0.7, or about 0.001 to about 0.6, or about 0.001 to about 0.5, or about 0.001 to about 0.4, or about 0.001 to about 0.3, or about 0.001 to about 0.2, or about 0.001 to about 0.1. If the total syndetics:total base surfactant weight ratio fall into any of disclosed ranges above, then the base surfactant, the hydrophilic syndetic and the hydrophobic syndetic reduce the interfacial tension between water and a canola oil below about 0.30 mN/m, as measured via spinning drop tensiometry at 25 C, in less than 15 minutes after contacting said composition with said canola oil.

Depending on the composition of the base surfactant or total base surfactant mixture selected, adjustment of the ratio of the hydrophilic to hydrophobic syndetic or syndetics may be necessary, in order to deliver the most rapid reduction in IFT between the aqueous solution and oil. The hydrophilic syndetic is the sum of weight percentages of hydrophilic syndetics in a composition. The hydrophobic syndetic is the sum of weight percentages of hydrophobic syndetics in a composition. In one aspect of the invention, the hydrophilic syndetic:hydrophobic syndetic weight ratio is between about 0.01 to about 3.0, or about 0.01 to about 2.5, or about 0.01 to about 2.0, or about 0.01 to about 1.5, or about 0.01 to about 1.0, or about 0.01 to about 0.9, or about 0.01 to about 0.8, or about 0.01 to about 0.7, or about 0.01 to about 0.6, or about 0.01 to about 0.5, or about 0.01 to about 0.4, or about 0.01 to about 0.3, or about 0.01 to about 0.2, or about 0.01 to about 0.1. If the hydrophilic syndetic:hydrophobic syndetic weight ratio fall into any of disclosed ranges above, then the surfactant, the hydrophilic syndetic and the hydrophobic syndetic reduce the interfacial tension between water and a canola oil below about 0.30 mN/m, as measured via spinning drop tensiometry at 25° C., in less than 15 minutes after contacting said composition with said canola oil.

Organic Chelating Agents

One aspect of the invention is a 2-hydroxycarboxylic acid or mixture of 2-hydroxycarboxylic acids or derivatives. Examples of 2-hydroxycarboxylic acids include tartaric acid, citric acid, malic acid, mandelic acid, glycolic acid, and lactic acid. Polymeric forms of 2-hydroxycarboxylic acid, such as polylactic acid, may also be employed.

Suitable amino carboxylates chelating agents include ethanol-diglycines, disodium cocoyl glutamatic acid, and methyl glycine di-acetic acid (MGDA), both in their acid form, or in their alkali metal, ammonium, and substituted ammonium salt forms. Further carboxylate chelating agents for use herein include salicylic acid, aspartic acid, glutamic acid, glycine, malonic acid or mixtures and derivatives thereof.

The compositions contain substantially no additional organic chelating agents. Suitable compositions comprise chelating agents in concentrations of about 0.5 to about 10.0% by weight, or about 0.5 to about 5.0% by weight, or about 0.5 to about 4.0% by weight, or about 0.5 to about 3.0% by weight, or about 0.5 to about 2.0% by weight.

Solvent

The cleaning compositions can contain limited amounts of organic solvents, such as ethanol, sorbitol, glycerol, propylene glycol, glycerol, 1,3-propanediol, and mixtures thereof. These solvents may be less than 10% of the composition; in more preferred embodiments, these solvents may be less than 5% of the composition. The incorporation of these solvents in the heavy duty cleaner formulations is quite useful for controlling aesthetic factors of the undiluted products, such as viscosity, and/or for controlling the stability of important adjuncts such as enzymes, and/or for controlling the stability of the undiluted formulations at temperatures significantly above or below ambient temperature. It is believed that the solvents mentioned above have essentially no role in the reduction of the IFT of the formulations, especially at the use dilutions used in the IFT measurements performed. Thus, it is also believed that these solvents have no significant effect on the cleaning performance of the formulations. The compositions preferably contain solvents from natural sources rather than solvents from synthetic petrochemical sources, such as glycol ethers, hydrocarbons, and polyalkylene glycols. Water insoluble solvents such as isoparafinic hydrocarbons, mineral spirits, alkylaromatics, terpenoids, terpenoid derivatives, terpenes, and terpenes derivatives can be mixed with a water-soluble solvent when employed. Methanol and propylene glycol may be incidental components in the cleaning compositions.

The compositions should be free of other organic solvents (or only trace amounts of less than 0.5% or 0.1%) other than the ones already enumerated above including. The compositions should be free of the following alkanols: n-propanol, isopropanol, butanol, pentanol, and hexanol, and isomers thereof. The compositions should be free of the following diols: methylene glycol, ethylene glycol, and butylene glycols. The compositions should be free of the following alkylene glycol ethers which include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. The compositions should be free of the following short chain esters which include, but are not limited to, glycol acetate, and cyclic or linear volatile methylsiloxanes. The composition should not contain any alkyl glycol ethers, alcohol alkoxylates, alkyl monoglycerolether sulfate, or alkyl ether sulfates.

Water

When the composition is an aqueous composition, water can be a predominant ingredient. The water should be present at a level of less than 90 weight percent, more preferably less than about 80 weight percent, and most preferably, less than about 70 weight percent. Deionized or filtered water is preferred.

Fragrances

The cleaning compositions can contain fragrances, especially fragrances containing essential oils, and especially fragrances containing d-limonene or lemon oil; or natural essential oils or fragrances containing d-limonene or lemon oil. Lemon oil and d-limonene compositions which are useful in the invention include mixtures of terpene hydrocarbons obtained from the essence of oranges, e.g., cold-pressed orange terpenes and orange terpene oil phase ex fruit juice, and the mixture of terpene hydrocarbons expressed from lemons and grapefruit. The essential oils may contain minor, non-essential amounts of hydrocarbon carriers. Suitably, the fragrance contains essential oil or lemon oil or d-limonene in the cleaning composition in an amount ranging from about 0.01 to about 5.0 weight percent, about 0.01 to about 4.0 weight percent, about 0.01 to about 3.0 weight percent, about 0.01 to about 2.0 weight percent, about 0.01 to about 1.0 weight percent, or about 0.01 to about 0.50 weight percent, or about 0.01 to about 0.40 weight percent, or about 0.01 to about 0.30 weight percent, or about 0.01 to about 0.25 weight percent, or about 0.01 to about 0.20 weight percent, or about 0.01 to about 0.10 weight percent, or about 0.05 to about 2.0 weight percent, or about 0.05 to about 1.0 weight percent, or about 0.5 to about 1.0 weight percent, or about 0.05 to about 0.40 weight percent, or about 0.05 to about 0.30 weight percent, or about 0.05 to about 0.25 weight percent, or about 0.05 to about 0.20 weight percent, or about 0.05 to about 0.10 weight percent.

Natural Thickener

The present compositions can also comprise an auxiliary nonionic or anionic polymeric thickening component, especially cellulose thickening polymers, especially a water-soluble or water dispersible polymeric materials, having a molecular weight greater than about 20,000. By "water-soluble or water dispersible polymer" is meant that the material will form a substantially clear solution in water at a 0.5 to 1 weight percent concentration at 25° C. and the material will increase the viscosity of the water either in the presence or absence of surfactant. Examples of water-soluble polymers which may desirably be used as an additional thickening component in the present compositions, are hydroxyethylcellulose, hydroxypropyl cellulose, hydroxypropyl methylcellulose, dextrans, for example Dextran purified crude Grade 2P, available from D&O Chemicals, carboxymethyl cellulose, plant exudates such as acacia, ghatti, and tragacanth, seaweed extracts such as sodium alginate, and sodium carrageenan. Preferred as the additional thickeners for the present compositions are natural polysaccharide or cellulose materials. Examples of such materials include, but are limited to, guar gum, locust bean gum, xanthan gum and mixtures thereof. The present invention may contain an anti-redeposition polymer. Examples of anti-redeposition polymers include, but are not limited to, inulin, derivatized inulin, guar and derivatized guar. Also suitable herein preferred is hydroxyethyl cellulose having a molecular weight of about 700,000. The thickeners are generally present in amounts of about 0.05 to about 2.0 weight percent, or about 0.1 to about 2.0 weight percent.

Dyes, Colorants, and Preservatives

The cleaning compositions optionally contain dyes, colorants and preservatives, or contain one or more, or none of these components. These dyes, colorants and preservatives can be natural (occurring in nature or slightly processed from natural materials) or synthetic. Natural preservatives include benzyl alcohol, potassium sorbate and bisabalol; sodium benzoate and 2-phenoxyethanol. Preservatives, when used, include, but are not limited to, mildewstat or bacteriostat, methyl, ethyl and propyl parabens, bisguanidine compounds (e.g. Dantagard and/or Glydant). The mildewstat or bacteriostat includes, but is not limited to, mildewstats (including non-isothiazolone compounds) including Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1,3 diol, from Boots Company Ltd., PROXEL CRL, a propyl-p-hydroxybenzoate, from ICI PLC; NIPASOL M, an o-phenyl-phenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G. Dyes and colorants include synthetic dyes such as Liquitint® Yellow or Blue or natural plant dyes or pigments, such as a natural yellow, orange, red, and/or brown pigment, such as carotenoids, including, for example, beta-carotene and lycopene. The compositions can additionally contain fluorescent whitening agents or bluing agents.

Adjuncts

The cleaning compositions optionally contain one or more of the following adjuncts: enzymes such as protease, amylase, mannanase, and lipase, stain and soil repellants, lubricants, odor control agents, perfumes, builders, fragrances and fragrance release agents, reducing agents such as sodium sulfite, and bleaching agents. Other adjuncts include, but are not limited to, acids, pH adjusting agents, electrolytes, dyes and/or colorants, solubilizing materials, stabilizers, thickeners, defoamers, hydrotropes, cloud point modifiers, preservatives, and other polymers. Electrolytes, when used, include, calcium, sodium and potassium chloride. Optional pH adjusting agents include inorganic acids and bases such as sodium hydroxide, and organic agents such as monoethanolamine, diethanolamine, and triethanolamine. Thickeners, when used, include, but are not limited to, polyacrylic acid, xanthan gum, calcium carbonate, aluminum oxide, alginates, guar gum, methyl, ethyl, clays, and/or propyl hydroxycelluloses.

Defoamers, when used, include, but are not limited to, silicones, aminosilicones, silicone blends, and/or silicone/hydrocarbon blends. Bleaching agents, when used, include, but are not limited to, peracids, hypohalite sources, hydrogen peroxide, and/or sources of hydrogen peroxide. In a preferred embodiment, the present invention includes a builder such as ethylenediamine disuccinate.

In a suitable embodiment the compositions contain an effective amount of one or more of the following enzymes: protease, lipase, amylase, cellulase, and mixtures thereof. Suitable enzymes are available from manufacturers including, but not limited to, Novozymes® and Genencor®.

pH

The pH of the cleaning composition is measured at 10% dilution. The cleaning compositions can have a pH of between 7 and 13, between 2 and 13, or between 7 and 10, or between 7 and 9, or between 7.5 and 8.5.

Disinfectant or Sanitizer

The cleaning compositions contain no, or substantially no, additional disinfectants or sanitizers, such as quaternary ammonium antimicrobials or biguanides. Although the compositions may contain minor amounts of traditional antimicrobials as preservatives or other uses, the compositions are without the use of traditional quaternary ammoniom compounds or phenolics. Non-limiting examples of these quaternary compounds include benzalkonium chlorides and/or substituted benzalkonium chlorides, di($C_6$-$C_{14}$)alkyl di short chain ($C_1$-$C_4$ alkyl and/or hydroxyalkl) quaternaryammonium salts, N-(3-chloroallyl)hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethyl-enzylmmonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are also in this class.

Surface Modifying Agents

Although the compositions contain surfactants which lower the surface energy during cleaning, the compositons generally contain no surface modifying agents, which provide a lasting surface modification to the cleaning surface. The surface modifying agents are generally polymers other than the cellulosic thickening polymers and provide spreading of the water on the surface or beading of water on the surface, and this effect is seen when the surface is rewetted and even when subsequently dried after the rewetting. Examples of surface modifying agents include polymers and co-polymers of N,N-dimethyl acrylamide, acrylamide, and certain monomers containing quaternary ammonium groups or amphoteric groups that favor substantivity to surfaces, along with co-monomers that favor adsorption of water, such as, for example, acrylic acid and other acrylate salts, sulfonates, betaines, and ethylene oxides. Other examples include organosilanes and organosilicone polymers, cationic polymers, hydrophobic amphoteric polymers, nanoparticles and hydrophobic organic polymers, such as waxes.

Cleaning Substrate

The cleaning composition is generally not impregnated in a cleaning substrate. Because of the limited number of ingredients, these compositions tend to perform better when used with a substrate at the time of application or use, and not sold as a pre-wetted substrate. Examples of unsuitable substrates include, nonwoven substrates, woven substrates, hydroentangled substrates, foams and sponges and similar materials which can be used alone or attached to a cleaning implement, such as a floor mop, handle, or a hand held cleaning tool, such as a toilet cleaning device. The terms "nonwoven" or "nonwoven web" means a web having a structure of individual fibers or threads which are interlaid, but not in an identifiable manner as in a knitted web.

EXAMPLES

The compositions are simple, natural, high performance cleaning formulations with a minimum of essential natural ingredients. Competitive cleaners are either natural and inferior in performance or contain additional ingredients that make them non-natural, such as surfactants based on nonrenewable petrochemicals. Because preservatives, dyes and colorants are used in such small amounts, these may be synthetic and the entire composition may still be characterized as natural. Preferably, the compositions contain only natural preservatives, dyes, and colorants, if any.

Table I illustrates natural heavy duty cleaners of the invention. Table II illustrates less concentrated natural heavy duty cleaners of the invention. All numbers are in weight percent of active ingredients.

TABLE I

| Natural Heavy Duty | A | B | C | D | E | F |
|---|---|---|---|---|---|---|
| Sodium lauryl sulfate | 16.6 | | 5.7 | | 10.0 | |
| MES[1] | | 11.1 | | | | 10.0 |
| Glucopon ® 600UP[2] | | | | 5.0 | 10.0 | |
| Glucopon ® 425N[3] | 7.8 | 8.0 | 2.7 | | | |
| Ammonyx LMDO[4] | 1.9 | 2.0 | 0.7 | | | |
| Ammonyx LO[5] | | | | | | 10.0 |
| AG 6206[6] | 2.9 | 1.0 | 1.0 | 2.0 | | |
| AG 6202[7] | | | | | 0.5 | 1.0 |
| Oleic Acid | 1.5 | 5.0 | 1.0 | | 0.5 | 1.0 |
| Sodium Citrate dihydrate | 3.0 | 6.0 | 2.0 | 2.0 | 1.0 | 1.0 |
| Sodium gluconate | | | | 1.0 | | |
| Boric acid | 1.5 | 1.5 | 3.0 | 3.0 | | 0.5 |
| Ca chloride | 0.1 | 0.1 | 0.1 | 0.1 | | 0.1 |
| Propylene glycol | 7.0 | 5.0 | | | | |
| Ethanol | | | 2.0 | | 5.0 | 2.0 |
| Glycerol | | | 8.0 | 10.0 | | |
| 1,3-Propane diol | | | | | | |
| Protease | 0.6 | 1.0 | 0.2 | 0.2 | 1.0 | 1.0 |
| Amylase | 0.3 | 0.6 | | | | |
| Sodium sulfite | | | 0.05 | | | |
| Dye | | | | | 0.1 | 0.1 |
| Preservative | 0.1 | 0.1 | 0.1 | 0.1 | 0.1 | 0.1 |
| FWA | | | | | 0.05 | |
| Thickener | | | 0.1 | 0.05 | | |
| Fragrance | 0.5 | 0.2 | 0.2 | 0.15 | 7.5 | 9.0 |
| NaOH to pH | 8.5 | 8.5 | 8.5 | 8.5 | | |
| Water | balance | balance | balance | balance | balance | balance |

[1]ALPHA-STEP ® MC-48 from Stepan Company.
[2]Coco glucoside from Cognis.
[3]from Cognis.
[4]from Lonza.
[5]from Lonza.
[6]from Akzo.
[7]from Akzo.

TABLE II

| Natural Heavy Duty | G | H | I | J | K | L |
|---|---|---|---|---|---|---|
| Sodium lauryl sulfate | 16.9 | | | | 17.5 | |
| MES | | 11.1 | 14.0 | 14.0 | | |
| Glucopon ® 625N | | | 7.0 | 7.0 | | |
| Glucopon ® 425N | 8.0 | 8.0 | | | 8.0 | 4.0 |
| Ammonyx LMDO | 2.0 | 2.0 | | | | |
| AG 6206 | 3.0 | 1.0 | 3.0 | | | |
| Hexyl sulfate | | | | | 1.0 | 3.0 |
| Oleic Acid | | | 5.0 | 5.0 | | 0.5 |
| Glycerol monooleate | 1.5 | | | | | |
| Sorbitan monooleate | | 1.5 | | | 0.5 | |
| Sodium Citrate dihydrate | | | 6.0 | 6.0 | | |
| Ca chloride | | | 0.1 | 0.1 | | |
| NaCl | | | 1.0 | 1.0 | 1.0 | 0.5 |
| Propylene glycol | | | 5.0 | 5.0 | | |
| Glycerol | 1.0 | | | | | |
| 1,3-Propane diol | | 1.0 | | | 3.0 | 3.0 |
| Preservative | 0.1 | 0.1 | 0.1 | 0.1 | | |
| Fragrance | | 0.2 | | | 0.1 | 0.1 |
| NaOH to pH | 8.5 | 8.5 | 8.5 | 8.5 | 10.0 | 7.0 |
| Water | balance | balance | balance | balance | balance | balance |

Formula A was compared for laundry wash performance with a leading commercial liquid laundry detergent containing non-natural ingredients. Stain removal was tested by washing coffee, tea, red wine, chocolate pudding, and gravy stains applied to four replicates of 100% cotton fabric at water of 93° F. and 100 ppm hardness in a 12-minute wash cycle in a Whirlpool top-load washing machine and reflectance of the stains via the L,a,b scale was then converted to a stain removal percentage. Formula A was superior to commercial detergent on coffee, tea, red wine, chocolate pudding, and gravy.

Formula D was compared for pretreatment performance against a leading commercial pretreatment product containing non-natural ingredients. Formulas were evaluated in a wash study using hand applied stains on pre-scoured white cotton T-shirts. 5 mL of product was pipetted onto each stain, allowed to sit for 5 minutes, and then washed in hot water with Tide® liquid detergent and dried in a standard dryer. Formula D showed parity stain removal performance on several stains and was superior to the commercial pretreatment product on wine stain.

Table III illustrates the effect of the hydrophilic syndetic in lowering the interfacial tension (IFT) of the composition for improved performance. Interfacial tension of the formulations at use dilution in the presence of 100 ppm hardness against canola oil was measured using a spinning drop tensiometer at room temperature. Composition I with the hydrophilic syndetic AG6206 achieves a lower IFT at faster times than Composition J, which doesn't have AG6206, and much faster that the commercial detergent ALL®.

TABLE III

| | IFT, 2 min | IFT, 7 min | IFT 12 min |
|---|---|---|---|
| Compositon I | 0.20 | 0.18 | 0.22 |
| Composition J | 0.26 | 0.25 | 0.28 |
| All Detergent | 0.46 | 0.32 | 0.51 |

TABLE IV

Example formulations with LMDO and AG 6206

| Natural Heavy Duty Cleaners | M | N | O | P |
|---|---|---|---|---|
| Sodium lauryl sulfate | 7.43 | 7.43 | 7.43 | 7.43 |
| MES | 7.65 | 7.65 | 7.65 | 7.65 |
| Glucopon ® 425N | 7.07 | 7.07 | 7.07 | 7.07 |
| Ammonyx LMDO | 4.46 | 2.48 | 3.63 | 4.62 |
| AG 6206 | 1.13 | 5.63 | 8.25 | 10.49 |
| Water | balance | balance | balance | balance |

TABLE IVa

Example formulations and interfacial tension (IFT, mN/m) with Canola oil at 25° C.

| Formulation | Total syndetic:Total base surfactant, weight ratio | Hydrophilic Syndetic:Hydrophobic syndetic Weight ratio | IFT @ 5 mins | IFT @ 10 mins | IFT @ 15 mins |
|---|---|---|---|---|---|
| M | 0.252 | 0.253 | 0.219 | 0.259 | 0.281 |
| N | 0.366 | 2.270 | 0.293 | 0.292 | 0.285 |
| O | 0.536 | 2.273 | 0.228 | 0.257 | 0.201 |
| P | 0.682 | 2.271 | 0.196 | 0.185 | 0.221 |

Table IV illustrates compositions in which an amido amine oxide is the hydrophobic syndetic and a $C_6$ alkyl polyglucoside is the hydrophilic syndetic. Table IVa illustrates compositions with a total syndetic:total base surfactant weight ratio between 0.252-0.682 produce an optimum reduction in the interfacial tension below 0.3 mN/m as measured via spinning drop tensiometry at 25° C., in less than 15 minutes after contacting the composition with said canola oil. Table IVa also illustrates compositions with a hydrophilic syndetic:hydrophobic syndetic weight ratio between 0.253-2.273 produce an optimum reduction in the interfacial tension below 0.3 mN/m as measured via spinning drop tensiometry at 25° C., in less than 15 minutes after contacting the composition with said canola oil. These data indicate that, surprisingly, the addition of a hydrophilic syndetic, when incorporated into formulations at the appropriate levels and ratios described, delivers a rapid decrease in IFT that is quite useful for boosting the detergency process. Those skilled in the art would realize that such a decrease is not expected nor achieved by utilizing a relatively more hydrophilic base surfactant package alone.

TABLE V

Example formulations with Oleic Acid

| Natural Heavy Duty Cleaners | Q | R | S | T |
|---|---|---|---|---|
| Sodium lauryl sulfate | 7.43 | 7.43 | 7.43 | 7.43 |
| MES | 7.65 | 7.65 | 7.65 | 7.65 |
| Glucopon ® 425N | 7.07 | 7.07 | 7.07 | 7.07 |
| Ammonyx LMDO | 1.74 | 1.74 | 1.74 | 1.74 |
| AG 6206 | 2.66 | 2.66 | 2.66 | 2.66 |
| Oleic Acid | 0.00 | 0.50 | 1.00 | 5.00 |
| Water | balance | balance | balance | balance |

TABLE Va

Example formulations and interfacial tension (IFT, mN/m) with Canola oil at 25° C.

| Formulation | Total syndetic:Total base surfactant, weight ratio | Hydrophilic Syndetic:Hydrophobic syndetic Weight ratio | IFT @ 5 mins | IFT @ 10 mins | IFT @ 15 mins |
|---|---|---|---|---|---|
| Q | 0.199 | 1.533 | 0.231 | 0.239 | 0.242 |
| R | 0.199 | 1.190 | 0.223 | 0.229 | 0.226 |
| S | 0.199 | 0.973 | 0.215 | 0.225 | 0.219 |
| T | 0.199 | 0.395 | 0.169 | 0.183 | 0.208 |

Table V illustrates compositions in which oleic acid and an amido amine oxide are the hydrophobic syndetics, and a $C_6$ alkyl polyglucoside is the hydrophilic syndetic. Table Va illustrates compositions with a total syndetic:total base surfactant weight ratio of 0.199 produce an optimum reduction in the interfacial tension below 0.3 mN/m as measured via spinning drop tensiometry at 25° C., in less than 15 minutes after contacting the composition with said canola oil. Table Va also illustrates that compositions with a hydrophilic syndetic: hydrophobic syndetic weight ratio between 0.395-1.533 produce an optimum reduction in the interfacial tension below 0.3 mN/m as measured via spinning drop tensiometry at 25° C., in less than 15 minutes after contacting said composition with said canola oil. This data also illustrate the surprising utility of adjustment of the ratios described above by changing the level of only one of the hydrophobic syndetics, even when the base surfactant mixture remains constant. Even though oleic acid, as a hydrophobic syndetic, might be thought to act by partitioning into the oil phase (here, the canola oil), when combined with a hydrophilic syndetic, a significant benefit in the extent and rapidity of the reduction of the IFT can be realized. In practice, work with formulations in which a limited number of materials with appropriate RCI values are to be used, and in which other aesthetic factors such as viscosity of the undiluted formulation, or stability of important adjuncts such as enzymes are to be simultaneously optimized, the adjustment of the extent of and rapidity of the reduction of IFT via adjustment of the ratios defined above, sometimes via changing only one of the syndetics, can be very useful.

TABLE VI

Example formulations with Span ® 20 (Sorbitan Monolaurate)

| Natural Heavy Duty | U | V | W | X |
|---|---|---|---|---|
| Sodium lauryl sulfate | 7.43 | 7.43 | 7.43 | 7.43 |

TABLE VI-continued

Example formulations with Span ® 20 (Sorbitan Monolaurate)

| Natural Heavy Duty | U | V | W | X |
|---|---|---|---|---|
| MES | 7.65 | 7.65 | 7.65 | 7.65 |
| Glucopon ® 425N | 7.07 | 7.07 | 7.07 | 7.07 |
| Ammonyx LMDO | 1.74 | 1.74 | 1.74 | 1.74 |
| AG 6206 | 2.66 | 2.66 | 2.66 | 2.66 |
| Span ® 20 (Sorbitan Monolaurate) | 0.00 | 0.55 | 1.40 | 2.00 |
| Water | balance | balance | balance | balance |

TABLE Via

Example formulations and interfacial tension (IFT, mN/m) with Canola oil at 25° C.

| Formulation | Total syndetic:total base surfactant, weight ratio | Hydrophilic Syndetic:Hydrophobic syndetic Weight ratio | IFT @ 5 mins | IFT @ 10 mins | IFT @ 15 mins |
|---|---|---|---|---|---|
| U | 0.199 | 1.533 | 0.231 | 0.239 | 0.242 |
| V | 0.223 | 1.164 | 0.184 | 0.206 | 0.226 |
| W | 0.262 | 0.849 | 0.182 | 0.195 | 0.212 |
| X | 0.289 | 0.721 | 0.157 | 0.169 | 0.179 |

Table VI illustrates compositions in which sorbitan monolaurate and an amido amine oxide are the hydrophobic syndetics and $C_6$ alkyl polyglucoside is the hydrophilic syndetic. Table VIa illustrates compositions with a total syndetic:total base surfactant weight ratio between 0.199-0.289 produce an optimum reduction in the interfacial tension below 0.3 mN/m as measured via spinning drop tensiometry at 25° C., in less than 15 minutes after contacting the composition with said canola oil. Table VIa also illustrates compositions with a hydrophilic syndetic:hydrophobic syndetic weight ratio between 0.721-1.533 produce an optimum reduction in the interfacial tension below 0.3 mN/m as measured via spinning drop tensiometry at 25° C., in less than 15 minutes after contacting said composition with said canola oil.

TABLE VII

Example formulations with Oleyl Alcohol

| Natural Heavy Duty Cleaners | Y | Z |
|---|---|---|
| Sodium lauryl sulfate | 7.43 | 7.43 |
| MES | 7.65 | 7.65 |
| Glucopon ® 425N | 7.07 | 7.07 |
| Ammonyx LMDO | 1.74 | 1.74 |
| AG 6206 | 2.66 | 2.66 |
| Oleyl Alcohol | 0.50 | 1.00 |
| Water | balance | Balance |

TABLE VIIa

Example formulations and interfacial tension (IFT, mN/m) with Canola oil at 25° C.

| Formulation | Total syndetic:total base surfactant, weight ratio | Hydrophilic Syndetic:Hydrophobic syndetic Weight ratio | IFT @ 5 mins | IFT @ 10 mins | IFT @ 15 mins |
|---|---|---|---|---|---|
| Y | 0.221 | 1.190 | 0.189 | 0.198 | 0.198 |
| Z | 0.244 | 0.973 | 0.216 | 0.205 | 0.205 |

Table VII illustrates compositions in which oleyl alcohol and an amido amine oxide are the hydrophobic syndetics and $C_6$ alkyl polyglucoside is the hydrophilic syndetic. Table VIa illustrates compositions with a total syndetic:total base surfactant weight ratio between 0.221-0.244 produce an optimum reduction in the interfacial tension below 0.3 mN/m as measured via spinning drop tensiometry at 25° C., in less than 15 minutes after contacting the composition with said canola oil. Table VIa also illustrates that compositions with a hydrophilic syndetic:hydrophobic syndetic weight ratio between 0.973-1.190 produce an optimum reduction in the interfacial tension below 0.3 mN/m as measured via spinning drop tensiometry at 25° C., in less than 15 minutes after contacting said composition with said canola oil.

TABLE VIII

Example formulations with Texapon ® 842 (a sodium octyl sulfate)

| Natural Heavy Duty Cleaners | AA | BB | CC | DD |
|---|---|---|---|---|
| Sodium lauryl sulfate | 5.18 | 5.06 | 5.63 | 5.63 |
| MES | 6.24 | 6.24 | 6.94 | 6.94 |
| Glucopon ® 425N | 5.30 | 5.30 | 5.30 | 5.30 |
| Ammonyx LMDO | 1.30 | 1.30 | 1.30 | 1.30 |
| Span ® 20 (Soribitan Monolaurate) | 1.50 | 1.50 | 1.50 | 1.50 |
| Texapon ® 842 (Sodium Octyl Sulfate) | 0.00 | 0.30 | 0.90 | 1.74 |
| Calcium Chloride | 0.07 | 0.07 | 0.07 | 0.07 |
| Sodium Citrate Dihydrate | 2.24 | 2.24 | 2.24 | 2.24 |
| Boric Acid | 1.13 | 1.13 | 1.13 | 1.13 |
| Sodium Hydroxide to pH 8.5 | 0.37 | 0.37 | 0.37 | 0.37 |
| Sorbitol 70% in Water | 1.87 | 1.87 | 1.87 | 1.87 |
| Protease | 0.69 | 0.69 | 0.69 | 0.69 |

TABLE VIII-continued

Example formulations with Texapon ® 842 (a sodium octyl sulfate)

| Natural Heavy Duty Cleaners | AA | BB | CC | DD |
|---|---|---|---|---|
| Amylase | 0.36 | 0.36 | 0.36 | 0.36 |
| Water | balance | balance | balance | balance |

TABLE VIIIA

Example formulations and interfacial tension (IFT, mN/m) with Canola oil at 25° C.

| Formulation | Total syndetic:Total base surfactant, weight ratio | Hydrophilic Syndetic:Hydrophobic syndetic Weight ratio | IFT @ 5 mins | IFT @ 10 mins | IFT @ 15 mins |
|---|---|---|---|---|---|
| AA | 0.167 | 0 | 0.291 | 0.241 | 0.237 |
| BB | 0.187 | 0.107 | 0.198 | 0.196 | 0.184 |

TABLE VIIIA-continued

Example formulations and interfacial tension (IFT, mN/m) with Canola oil at 25° C.

| Formulation | Total syndetic:Total base surfactant, weight ratio | Hydrophilic Syndetic:Hydrophobic syndetic Weight ratio | IFT @ 5 mins | IFT @ 10 mins | IFT @ 15 mins |
|---|---|---|---|---|---|
| CC | 0.207 | 0.321 | 0.150 | 0.151 | 0.167 |
| DD | 0.254 | 0.621 | 0.211 | 0.167 | 0.197 |

Table VIII illustrates compositions in which sodium octyl sulfate is the hydrophilic syndetic and an amido amine oxide and sorbitan monolaurate are the hydrophobic syndetics. Table VIIIa illustrates compositions with a total syndetic:total base surfactant weight ratio between 0.167-0.254 produce an optimum reduction in the interfacial tension below 0.3 mN/m as measured via spinning drop tensiometry at 25° C., in less than 15 minutes after contacting the composition with said canola oil. Table VIIIa also illustrates compositions with a hydrophilic syndetic:hydrophobic syndetic weight ratio between 0-0.621 produce an optimum reduction in the interfacial tension below 0.3 mN/m as measured via spinning drop tensiometry at 25° C., in less than 15 minutes after contacting said composition with said canola oil. The data also illustrate that a significant decrease in the IFT is achieved by increasing the concentration of the hydrophilic syndetic, which is a trend not expected or achieved through the use of base surfactant mixtures only, in the absence of a hydrophilic and hydrophobic syndetic.

TABLE IX

Example formulations with Texapon ® 842 (a sodium octyl sulfate)

| Natural Heavy Duty Cleaner | EE |
|---|---|
| Sodium lauryl sulfate | 6.75 |
| MES | 8.33 |
| Glucopon ® 425N | 7.07 |
| Ammonyx LMDO | 1.74 |
| Span ® 20 (Sorbitan Monolaurate) | 2.00 |
| Texapon ® 842 (Sodium Octyl Sulfate) | 1.20 |
| Calcium Chloride | 0.10 |
| Sodium Citrate Dihydrate | 2.99 |

TABLE IX-continued

Example formulations with Texapon ® 842 (a sodium octyl sulfate)

| Natural Heavy Duty Cleaner | EE |
|---|---|
| Boric Acid | 1.50 |
| Sodium Hydroxide to pH 8.5 | 0.50 |
| Sorbitol 70% in Water | 2.49 |
| Protease | 0.92 |
| Amylase | 0.48 |
| Water | balance |

TABLE IXa

Example formulations and interfacial tension (IFT, mN/m) with Canola oil at 25° C.

| Formulation | Total syndetic:total base surfactant, weight ratio | Hydrophilic Syndetic:Hydrophobic syndetic Weight ratio | IFT @ 5 mins | IFT @ 10 mins | IFT @ 15 mins |
|---|---|---|---|---|---|
| EE | 0.223 | 0.321 | 0.197 | 0.200 | 0.200 |
| 2X Ultra Tide ® HE | — | — | 0.229 | 0.226 | 0.276 |

Table IX illustrates compositions in which Texapon® 842 (a sodium octyl sulfate) is the hydrophilic syndetic and sorbitan monolaurate and an amido amine oxide are the hydrophobic syndetics. Table IXa illustrates a composition with a total syndetic:total base surfactant weight ratio of 0.223 produces an optimum reduction in the interfacial tension below 0.3 mN/m as measured via spinning drop tensiometry at 25° C., in less than 15 minutes after contacting the composition with said canola oil. Table IXa also illustrates a composition with a hydrophilic syndetic:hydrophobic syndetic weight ratio 0.321 produces an optimum reduction in the interfacial tension below 0.3 mN/m as measured via spinning drop tensiometry at 25° C., in less than 15 minutes after contacting said composition with said canola oil. Table IXa also shows a lower IFT when formulation EE is compared with a synthetic (non-natural) detergent 2× Ultra Tide® HE at 5, 10 and 15 minute intervals.

TABLE X

Example formulations comprising a Single Anionic Surfactant in the Base Surfactant Mixture

| Natural Heavy Duty | FF | GG | HH | II | JJ |
|---|---|---|---|---|---|
| Sodium lauryl sulfate | 16.91 | 14.37 | 14.37 | 0.00 | 0.00 |
| MES | 0.00 | 0.00 | 0.00 | 11.10 | 11.10 |
| Glucopon ® 425N | 8.00 | 6.80 | 6.80 | 8.00 | 8.00 |

TABLE X-continued

| Natural Heavy Duty | FF | GG | HH | II | JJ |
|---|---|---|---|---|---|
| | Example formulations comprising a Single Anionic Surfactant in the Base Surfactant Mixture | | | | |
| Ammonyx LMDO | 1.98 | 1.68 | 1.68 | 1.98 | 1.98 |
| AG 6206 | 3.00 | 2.55 | 2.55 | 0.98 | 0.98 |
| Calcium Chloride | 0.10 | 0.10 | 0.10 | 0.10 | 0.10 |
| Sodium Citrate Dihydrate | 3.00 | 3.00 | 3.00 | 6.00 | 6.00 |
| Boric Acid | 1.50 | 1.50 | 1.50 | 1.50 | 1.50 |
| Sodium Hydroxide to pH 8.5 | 0.50 | 0.50 | 0.50 | 0.50 | 0.50 |
| Oleic Acid | 1.50 | 1.28 | 1.28 | 5.00 | 5.00 |
| Sorbitol 70% in Water | 0.00 | 0.00 | 3.00 | 0.00 | 2.50 |
| Protease | 0.51 | 0.00 | 0.00 | 0.00 | 0.00 |
| Amylase | 0.26 | 0.00 | 0.00 | 0.00 | 0.00 |
| Ethanol | 0.00 | 3.00 | 3.00 | 2.50 | 2.50 |
| Glycerol | 0.00 | 3.00 | 0.00 | 2.50 | 0.00 |
| Propyelene Glycol | 7.00 | 0.00 | 0.00 | 0.00 | 0.00 |
| Preservative | 0.10 | 0.03 | 0.10 | 0.10 | 0.10 |
| Fragrance | 0.50 | 0.50 | 0.50 | 0.50 | 0.50 |
| Water | balance | balance | balance | balance | balance |

TABLE Xa

Example formulations and interfacial tension (IFT, mN/m) with Canola oil at 25° C.

| Formulation | Total Hydrophilic + Hydrophobic Syndetic/Total Base Surfactant | Hydrophilic Syndetic:Hydrophobic syndetic Weight ratio | IFT @ 5 min. | IFT @ 10 min. | IFT @ 15 min. |
|---|---|---|---|---|---|
| FF | 0.260 | 0.862 | 0.138 | 0.132 | 0.132 |
| GG | 0.260 | 0.862 | 0.117 | 0.115 | 0.100 |
| HH | 0.260 | 0.862 | 0.086 | 0.113 | 0.131 |
| II | 0.416 | 0.140 | 0.220 | 0.206 | 0.21 |
| JJ | 0.416 | 0.140 | 0.170 | 0.158 | 0.160 |

Table X illustrates compositions comprising a single anionic surfactant (either sodium lauryl sulfate or MES) in the base surfactant mixture comprising the anionic and a nonionic alkyl glucoside (Glucopon® 425N). Table Xa illustrates compositions with a total syndetic:total base surfactant weight ratio between 0.260-0.416 produce an optimum reduction in the interfacial tension below 0.3 mN/m as measured via spinning drop tensiometry at 25° C., in less than 15 minutes after contacting the composition with said canola oil. Table Xa also illustrates compositions with a hydrophilic syndetic:hydrophobic syndetic weight ratio between 0.140-0.862 produce an optimum reduction in the interfacial tension below 0.3 mN/m as measured via spinning drop tensiometry at 25° C., in less than 15 minutes after contacting said composition with said canola oil.

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

We claim:

1. A natural heavy duty cleaning composition consisting essentially of:

a. an anionic surfactant selected from the group consisting of sodium lauryl sulfate, sodium alkyl α-sulfomethyl ester, and combinations thereof;

b. a hydrophilic syndetic selected from the group consisting of $C_6$ alkyl polyglucoside, $C_6$ to $C_8$ alkyl polyglucoside, $C_8$ alkyl polyglucoside and combinations thereof;

c. a hydrophobic syndetic selected from an amine oxide;

d. a solvent selected from the group consisting of propylene glycol, 1,3-propanediol, ethanol, sorbitol, glycerol and combinations thereof;

e. an organic chelating agent selected from the group consisting of 2-hydroxyacids, 2-hydroxyacid derivatives, glutamic acid, glutamic acid derivatives, and mixtures thereof;

f. optionally a nonionic surfactant selected from the group consisting of alkyl polyglucosides having chain lengths greater than $C_8$, and combinations thereof; and g. optional ingredients selected from pH adjusting agents, builders, calcium salts, boric acid or borate, enzymes, dyes, colorants, fragrances, preservatives, fluorescent whitening agents, bluing agents, defoamers, bleaches, thickeners anti-redeposition polymers and combinations thereof;

wherein the ratio of the total syndetics:total base surfactant is between 0.001 to 1.0.

2. The composition of claim 1, wherein said anionic surfactant, said hydrophilic syndetic and said hydrophobic syndetic reduce the interfacial tension between water and a canola oil below about 0.3 mN/m, as measured via spinning drop tensiometry at 25° C., in less than 15 minutes after contacting said composition with said canola oil.

3. The composition of claim 1, wherein the composition does not contain alkyl glycol ethers, alcohol alkoxylates, alkyl monoglycerolether sulfate, or alkyl ether sulfates.

4. The composition of claim 1, wherein the solvent is selected from the group consisting of propylene glycol, sorbitol, glycerol, and combinations thereof.

5. The composition of claim 1, wherein the anionic surfactant is sodium lauryl sulfate.

6. The composition of claim 1, wherein the anionic surfactant is sodium alkyl α-sulfomethyl ester.

7. The composition of claim 1, wherein the amine oxide is selected from the group consisting of dimethyl alkyl amine oxide, amido amine oxide, diethyl alkyl amine oxide and combinations thereof.

8. A natural heavy duty cleaning composition consisting essentially of:

a. an anionic surfactant selected from the group consisting of a fatty alcohol sulfate, an alkyl α-sulfomethyl ester, and combinations thereof;

b. a hydrophilic syndetic selected from the group consisting of $C_6$ alkylpolyglucoside, $C_6$ to $C_8$ alkylpolyglucoside, $C_8$ alkylpolyglucoside, $C_6$ alkyl sulfate, $C_6$ to $C_8$ alkyl sulfate, $C_8$ alkyl sulfate, and combinations thereof;

c. a hydrophobic syndetic selected from the group consisting of amine oxide, a fatty acid, a fatty alcohol, a sterol, a sorbitan fatty acid ester, a glycerol fatty acid ester, and combinations thereof;

d. a solvent selected from the group consisting of propylene glycol, 1,3-propanediol, ethanol, sorbitol, glycerol and combinations thereof;

e. an organic chelating agent selected from the group consisting of 2-hydroxyacids, 2-hydroxyacid derivatives, glutamic acid, glutamic acid derivatives, and mixtures thereof;

f. pH 7-13;

g. optionally a nonionic surfactant selected from the group consisting of an alkoxylated amine, alkylpolyglucoside having chain lengths from $C_8$ to $C_{20}$, alkyldiethanolamide, alkylethanolamide, and combinations thereof;

h. optionally an amphoteric surfactant selected from the group consisting of sarcosinate, tauride, betaine, sulfobetaine and combinations thereof; and i. optional ingredients selected from pH adjusting agents, alkanolamines, calcium salts, boric acid, enzymes, dyes, colorants, fragrances, preservatives, fluorescent whitening agents, bluing agents, defoamers, bleaches, thickeners, anti-redeposition polymers and combinations thereof;

wherein the ratio of the total syndetics:total base surfactant is between 0.001 to 1.0.

9. The composition of claim 8, wherein said anionic surfactant, said hydrophilic syndetic and said hydrophobic syndetic reduce the interfacial tension between water and a canola oil below about 0.3 mN/m, as measured via spinning drop tensiometry at 25° C., in less than 15 minutes after contacting said composition with said canola oil.

10. The composition of claim 8, wherein the composition does not contain alkyl glycol ethers, alcohol alkoxylates, alkyl monoglycerolether sulfate, or alkyl ether sulfates.

11. The composition of claim 8, wherein the solvent is selected from the group consisting of propylene glycol, sorbitol, glycerol, and combinations thereof.

12. The composition of claim 8, wherein the anionic surfactant is sodium lauryl sulfate.

13. The composition of claim 8, wherein the anionic surfactant is sodium alkyl α-sulfomethyl ester.

14. The composition of claim 8, wherein the hydrophobic syndetic is amine oxide.

15. The composition of claim 14, wherein the amine oxide is selected from the group consisting of dimethyl alkyl amine oxide, amidoamine oxide, diethyl alkyl amine oxide and combinations thereof.

16. The composition of claim 15, wherein the amine oxide is a $C_{12}$-$C_{18}$ amine oxide.

17. The composition of claim 8, wherein the hydrophilic syndetic is an alkyl polyglucoside.

18. A natural heavy duty cleaning composition comprising:

a. an anionic surfactant selected from the group consisting of a fatty alcohol sulfate an alkyl α-sulfomethyl ester and combinations thereof;

b. a hydrophilic syndetic selected from the group consisting of $C_6$ alkylpolyglucoside, $C_6$ to $C_8$ alkylpolyglucoside, $C_8$ alkylpolyglucoside, $C_6$ alkyl sulfate, $C_6$ to $C_8$ alkyl sulfate, $C_8$ alkyl sulfate, and combinations thereof;

c. a hydrophobic syndetic selected from the group consisting of a fatty acid, a fatty alcohol, a sterol, a sorbitan fatty acid ester, a glycerol fatty acid ester, and combinations thereof;

d. a solvent selected from the group consisting of 1,3-propanediol, sorbitol, glycerol and combinations thereof;

e. optionally a nonionic surfactant selected from the group consisting of an alkoxylated amine, alkylpolyglucoside having chain lengths from $C_8$ to $C_{20}$, alkyldiethanolamide, alkylethanolamide, and combinations thereof;

f. optionally an amphoteric surfactant selected from the group consisting of sarcosinate, tauride, betaine, sulfobetaine and combinations thereof;

g. optionally an organic chelating agent from the group consisting of 2-hydroxyacids, 2-hydroxyacid derivatives, glutamic acid, glutamic acid derivatives, and mixtures thereof; and h. optional ingredients selected from pH adjusting agents, alkanolamines, calcium salts, boric acid, enzymes, dyes, colorants, fragrances, preservatives, fluorescent whitening agents, bluing agents, sodium gluconate, defoamers, bleaches, thickeners, anti-redeposition polymers, ethanol, propylene glycol, and combinations thereof;

wherein the ratio of the total syndetics:total base surfactant is between 0.001 to 1.0, and wherein the composition does not contain alkyl glycol ethers, alcohol alkoxylates, alkyl monoglycerolether sulfate, or alkyl ether sulfates.

19. The composition of claim 18, wherein said anionic surfactant, said hydrophilic syndetic and said hydrophobic syndetic reduce the interfacial tension between water and a canola oil below about 0.3 mN/m, as measured via spinning drop tensiometry at 25° C., in less than 15 minutes after contacting said composition with said canola oil.

20. The composition of claim 19, wherein the composition requires a sodium gluconate.

21. The composition of claim 19, wherein the hydrophilic syndetic is a $C^6$ alkylpolyglucoside.

22. The composition of claim 19, wherein the solvent is a glycerol.

23. The composition of claim 19, wherein the hydrophobic syndetic is a sorbitan fatty acid ester.

24. The composition of claim 19, wherein the hydrophobic syndetic is a glycerol fatty acid ester.

* * * * *